United States Patent [19]

Szuster

[11] Patent Number: 4,943,029

[45] Date of Patent: Jul. 24, 1990

[54] COMPUTER CARRY BASKET

[76] Inventor: Paul A. P. Szuster, 64 Clifton Street, Malvern, South Australia, Australia, 5061

[21] Appl. No.: 386,365

[22] Filed: Jul. 26, 1989

[51] Int. Cl.[5] ..... A47F 5/00

[52] U.S. Cl. ..... 248/917; 248/639; 248/175; 211/181

[58] Field of Search ..... 248/917, 918, 639, 676, 248/680, 146, 150, 154, 165, 175, 176, 153; 211/181, 186, 195; 108/91, 92, 53.1

[56] References Cited

U.S. PATENT DOCUMENTS

| | | | |
|---|---|---|---|
| 1,612,937 | 1/1927 | Mitchell | 248/150 |
| 2,448,319 | 8/1948 | Maranville | 211/181 |
| 2,650,105 | 8/1953 | Costikyan | 248/499 |
| 3,013,670 | 12/1961 | Mayer | 211/181 |
| 3,225,720 | 12/1965 | Maslow | 211/181 |
| 3,225,939 | 12/1965 | Braun | 211/186 |
| 3,485,381 | 12/1969 | Grubb | 211/186 |
| 4,191,160 | 3/1980 | Elliott | 211/181 |
| 4,595,107 | 6/1986 | Welsch | 211/181 |
| 4,616,756 | 10/1986 | Holtz | 211/181 |
| 4,718,402 | 1/1988 | Fordyce | 248/153 |

FOREIGN PATENT DOCUMENTS

| | | | |
|---|---|---|---|
| 1133618 | 11/1956 | France | 211/181 |

*Primary Examiner*—Ramon O. Ramirez
*Assistant Examiner*—Robert A. Olson
*Attorney, Agent, or Firm*—Edward W. Callan

[57] ABSTRACT

A support frame for supporting a computer and its accessories comprises a base frame assembly and an upper frame assembly, each having two side rails and two end rails defining a respective peripheral frame, retaining means on each peripheral frame to retain a computer or a computer accessory against dislodgement when supported by the base or upper frame assembly, and two carry handle assemblies which join the rails of the base frame and upper frame assemblies and retain them horizontal, each handle assembly having a handle which extends outwardly away from sides of both the base and upper frame assemblies.

4 Claims, 3 Drawing Sheets

COMPUTER CARRY BASKET

This invention relates to a support frame, which is suitable for carrying a computer and its accessories, accessories including for example a printer, monitor and other accessories which may be associated with a computer.

BACKGROUND OF THE INVENTION

A personal computer and its accessories usually are discrete members and are of such weight that they are difficult to easily handle, and for example in a school where it is necessary to move a computer assembly with accessories from one classroom to another, a great deal of time can be saved if the entire assembly can be moved without electrical disconnections and without the need for separately oarrying the various items.

BRIEF SUMMARY OF THE INVENTION

In an embodiment of this invention a support frame for supporting a computer and its accessories comprises a base frame assembly and an upper frame assembly, each having two side rails and two end rails defining a respective peripheral frame, retaining means on each peripheral frame to retain a computer or a computer accessory against dislodgement when supported by the base or upper frame assembly, and two carry handle assemblies which join the rails of the base frame and upper frame assemblies and retain them horizontal, each handle assembly having a handle which extends outwardly away from sides of both the base and upper frame assemblies.

Another difficulty which is encountered is in the transport of a support frame, and in an aspect of the invention the retaining means comprise first spigot-and-socket connectors between the base frame assembly and the handle assemblies and second spigot-and-socket connectors between the upper frame assembly and the handle assemblies. This arrangement simplifies knock down of the assemblies for transport purposes, and re-erection. If the first and second spigot-and-socket connectors are at right angles to each other, the support frame can be quite rigid.

BRIEF SUMMARY OF THE DRAWINGS

An embodiment of the invention is described hereunder in some detail with reference to and is illustrated in the accompanying drawings in which.

DETAILED DESCRIPTION OF THE PREFERRED EMBODIMENT

Figure 1:
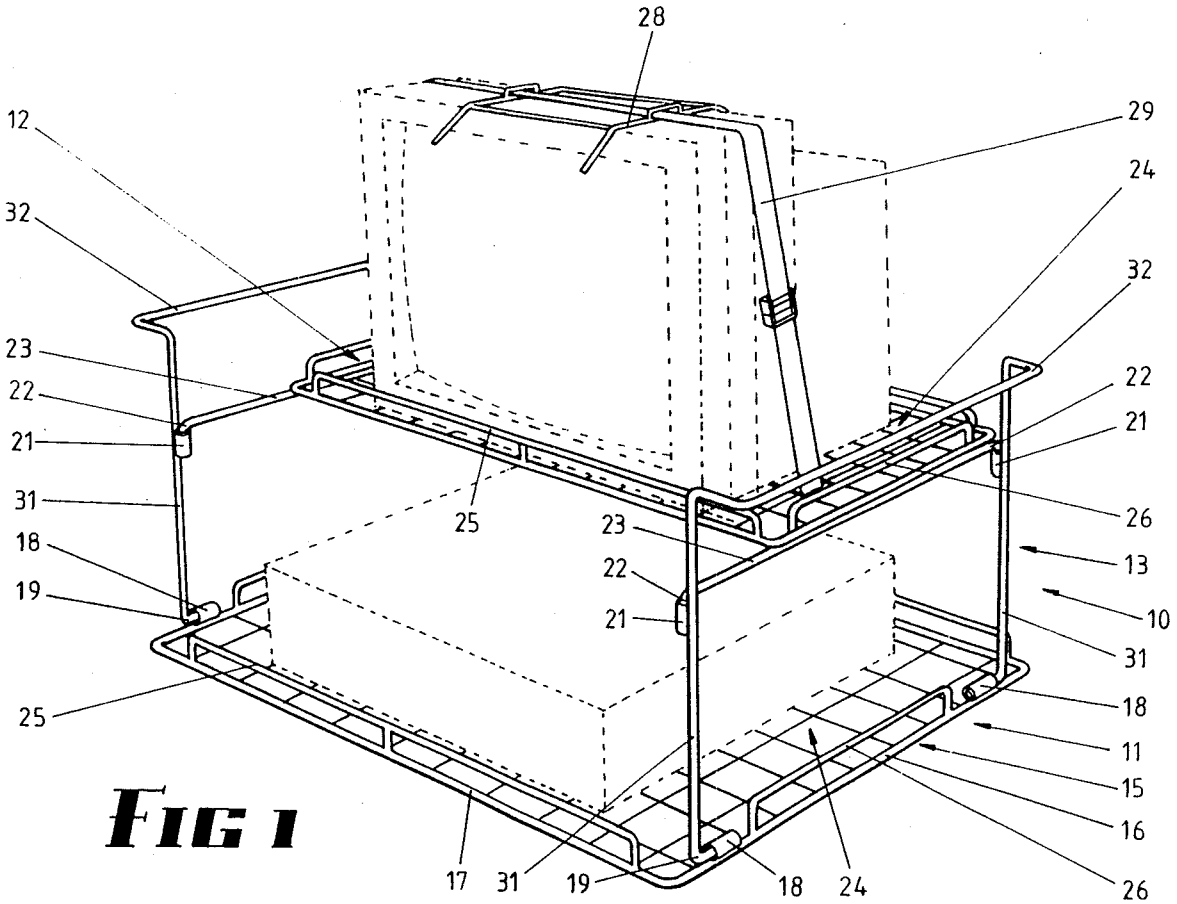
FIG. 1 is a perspective view of a carry basket when erected, showing in chain-dot a computer on the base frame assembly and its monitor on the upper frame assembly.

In this embodiment, a support frame 10 comprises a base frame assembly 11, an upper frame assembly 12, and a pair of spaced carry assemblies 13.

The base frame assembly 11 comprises a peripheral frame 15 which has two end rails 16 and two side rails 17, each of the end rails having on it a pair of co-axial horizontal socket sleeves 18, and these are engaged by inturned spigots 19 at the lower ends of the carry handle assemblies 13.

Each carry handle assembly 13 carries on it a pair of vertically extending socket sleeves 21 and each socket sleeve 21 is engaged by a respective downturned spigot 22 of a side frame rail 23 of the upper frame assembly 12. As seen best in FIG. 1, when erected the socket sleeves 18 are at right angles to the socket sleeves 21 and the engagement therefore is such that a rigidity is imparted to the entire assembly.

Each of the upper and base frame assemblies 12 and 11 comprises a central panel portion 24 which, in this embodiment, comprises intersecting rods. The upper frame assembly 12 may also be provided with a secondary shelf which is spaced a little below the panel portion thereof for storing printing paper, but this is not illustrated. Both the upper and base frame assemblies are also provided with transversely extending retention rails 25 and end retention rails 26 which assist in retaining the computer and its accessories in position. To further secure a computer or its accessories in position, use can be made of a bridge 28 having a pair of depending hooks and a strap 29 which clamps it against the relevant component and holds it firmly in engagement with a panel portion, for example, as illustrated to secure a monitor firmly in place on the upper panel portion 24.

Figure 2:
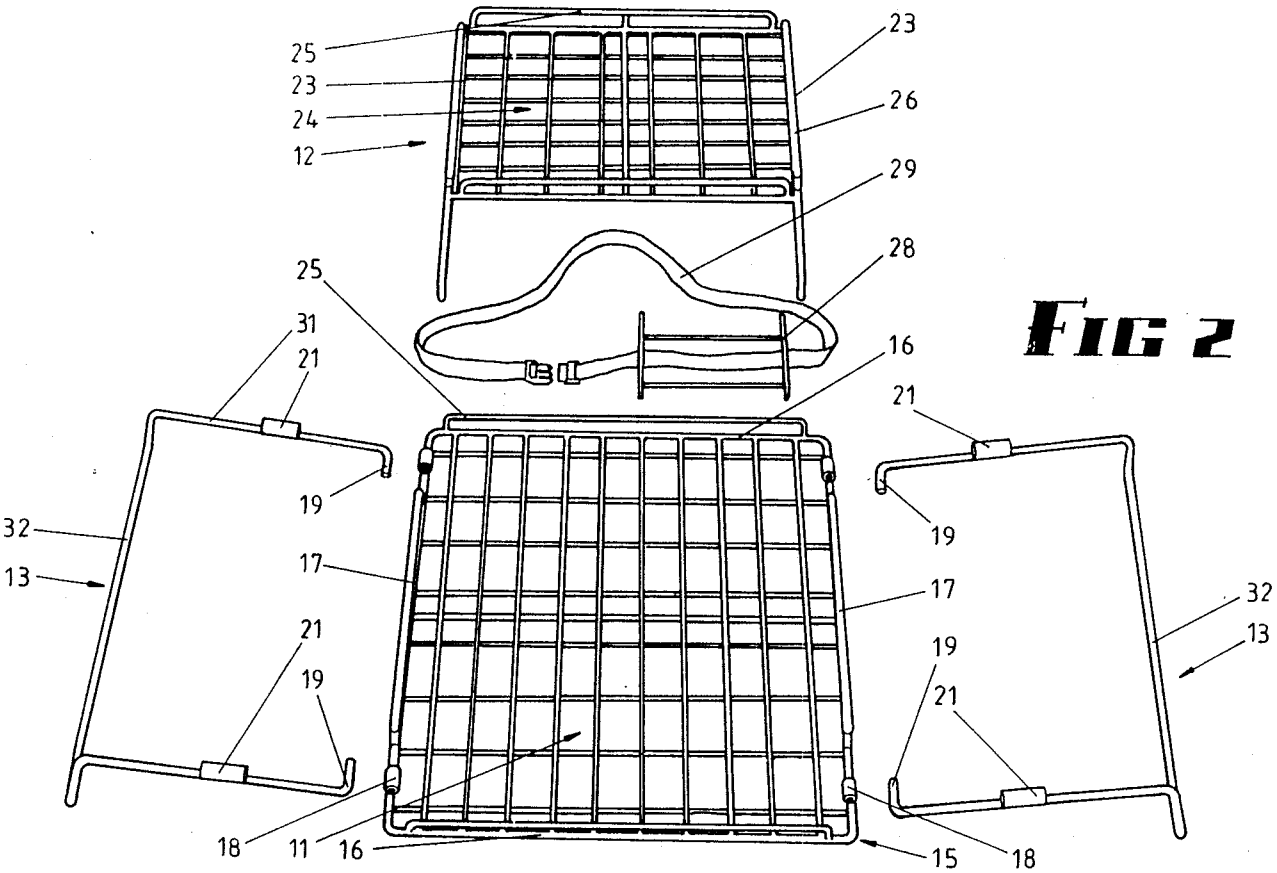
FIG. 2 is an "exploded" view showing the assemblies when knocked down.
Figure 3:
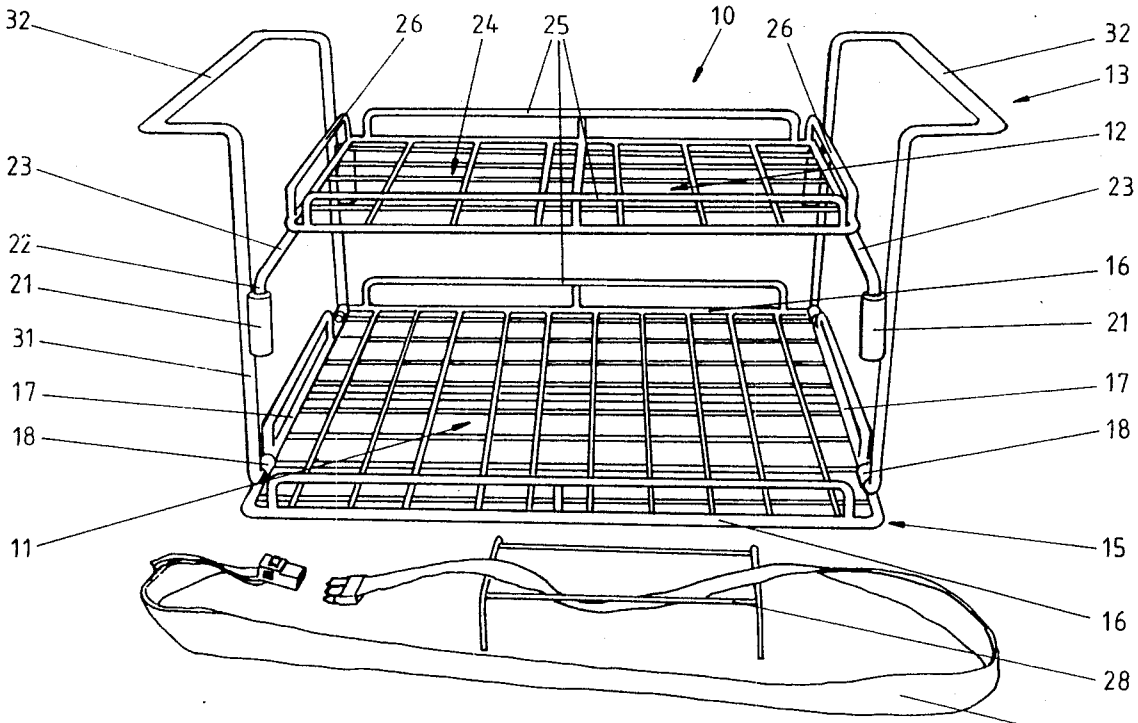
FIG. 3 is a perspective view showing the assemblies when erected.

The support frame when assembled takes a configuration as shown in FIGS. 1 and 3, and when disassembled as shown in FIG. 2. If the spigots 22 of the upper frame assembly 12 are first lifted away from the carry handle socket sleeves 21, the legs 31 of the carry handle frame assembly 13 can be sprung outwardly from one another to release the carry handle frame assembly 13 from the base frame assembly 11. All elements can then be packed in a relatively flat package. However when the spigots engage the sockets, rigidity is imparted against relative hinging movement in all planes because the spigots and sockets are at right angles to one another at each end of the carry basket. The carry handles 32 of respective assemblies 13 extend outwardly away from the sides of the base and upper frame assemblies 11 and 12 to facilitate handling.

A consideration of the above embodiment will indicate that the invention is very simple but nevertheless provides an effective and particularly useful arrangement for the transport of computers and their accessories. It is however not limited to such use and can be used for other assemblies as may be required.

I claim:

1. A support frame for supporting a computer and its accessories, comprising a base frame assembly and an upper frame assembly, each having two side rails and two end rails defining a respective peripheral frame, retaining means on one said peripheral frame upstanding from the rails thereof sufficiently to retain a computer and on the other said frame, upstanding sufficiently to retain a computer accessory, against dislodgement when supported by the base or upper frame assembly.

two carry handle assemblies each comprising a pair of legs, a respective said carry handle bridging the legs, and extending outwardly away from the sides of the base and upper frame assemblies, each leg terminating in an inturned spigot, and a respective vertical socket sleeve on each said leg between its ends, downwardly directed spigots on each of said side rails of the upper frame assembly which slidably engage within respective said vertical socket sleeves, two further socket sleeves on each said end rail of the base frame assembly which are horizontal, and inturned spigots on the lower ends of said carry handle legs engaging within respective said horizontal socket sleeves, such that the handle assemblies retain the base and upper frame assemblies horizontal and in spaced relation to one another.

2. A support frame according to claim 1 wherein said retaining means comprise transverse and end retention rails attached to said peripheral frames.

3. A support frame according to claim 1 or claim 2 wherein each said base frame and upper frame assembly comprises a central panel portion of intersecting rods.

4. A support frame according to claim 1 further comprising a bridge engageable over a computer accessory and a strap coupled to the bridge and operable to retain the computer accessory to a said base or upper frame assembly.

* * * * *